US005936582A

United States Patent [19]

Wallace et al.

[11] Patent Number: 5,936,582

[45] Date of Patent: Aug. 10, 1999

[54] DUAL PURPOSE GROUNDED INTERFACE FOR ANTENNA AND TEST EQUIPMENT

[75] Inventors: Raymond C. Wallace, San Diego; John K. M. Lee, Ramona, both of Calif.

[73] Assignee: QUALCOMM Incorporated, San Diego, Calif.

[21] Appl. No.: 08/812,173

[22] Filed: Mar. 6, 1997

[51] Int. Cl.[6] ..... H01Q 1/24

[52] U.S. Cl. ..... 343/702; 343/727; 343/906

[58] Field of Search ..... 343/702, 727, 343/906

[56] References Cited

U.S. PATENT DOCUMENTS 5,572,227 11/1996 Pal et al. ..... 343/727

5,659,889 8/1997 Cockson ..... 343/702

*Primary Examiner*—Don Wong

*Assistant Examiner*—Hoang Nguyen

*Attorney, Agent, or Firm*—Russell B. Miller; Charles D. Brown

[57] ABSTRACT

An antenna interface for a wireless communication device is provided which comprises an outer grounded shell and an inner signal shell, separated by an intermediate dielectric shell. Preferably, the interior surface of the inner signal shell is threaded to accept either an antenna securement member, or a test equipment interface connector. With this interface, an antenna can be driven by the inner signal shell, and two-conductor test equipment can be coupled to the wireless communication device via both the inner signal shell and the outer grounded shell.

2 Claims, 4 Drawing Sheets

DUAL PURPOSE GROUNDED INTERFACE FOR ANTENNA AND TEST EQUIPMENT

BACKGROUND OF THE INVENTION

I. Field of the Invention

The present invention relates to wireless communication devices, and their production, testing, and use. More particularly, the present invention relates to a novel and improved dual purpose interface for a wireless communication device such as a cellular telephone which interfaces with an antenna in normal use, and interfaces with test equipment during production line testing.

II. Description of the Related Art

Wireless communication devices are becoming increasingly prevalent, with cellular telephones being a particularly notable example. With these devices, radio-frequency (RF) signals are produced and transmitted as well as received to create communication links between remote devices. During the manufacture of such devices, it is an essentially universal practice to functionally test the RF signal generating circuitry prior to shipment of the device to a customer.

The typical testing procedure for doing this comprises placing a small receiving antenna near an antenna on the wireless communication device. Test signals are transmitted between these antennas to test sensitivity, output power, and other parameters of the RF signal generating and receiving circuitry contained inside the device. In a cellular telephone, for example, two antennas may be provided, each of which can be used to transmit and receive RF signals. These two antennas may comprise a retractable monopole antenna for normal RF transmission by the customer when placing telephone calls, and a small helical antenna which remains external to the telephone body even when the antenna is retracted. The helical antenna can be used to receive RF signals initiated by a party placing a call to the cellular telephone. An example of such a system is disclosed in U.S. Pat. No. 5,353,036 to Baldry. With this configuration, the helical antenna may be used for transmitting and receiving signals to and from the test receiving antenna. Although acceptably precise measurements of the cellular telephone performance characteristics can be made with this system under some conditions, it is difficult to prevent the accumulation of small errors in the manufacturing environment which degrade the quality of the results obtained. Furthermore, in the manufacturing environment, where many phones may be tested simultaneously, interference from neighboring RF sources can affect measurement accuracy.

In spite of the drawbacks of this test methodology, wireless communication devices have generally not included suitable interface hardware for testing which does not rely on radiative coupling. In U.S. Pat. No. 5,394,162 to Korovesis, et al., these problems are considered in conjunction with the testing of cellular telephones mounted inside vehicles. In this case, the antenna is usually provided on an exterior surface of the vehicle, such as the rear window, to transmit the RF signals out of the vehicle itself. In particular, Korovesis et al. describe an RF coupler with a ground plane having a hole in its center which is placed over the antenna interface on the rear window prior to installation of the antenna. A semicircular contact is placed in electrical contact with the antenna interface base. Although this apparatus allows telephone testing without using the antenna element, interference can still be a problem. To help minimize such interference, a mesh EMI shield is preferably placed over the test apparatus during use.

SUMMARY OF THE INVENTION

The present invention is a novel and improved antenna interface for a wireless communication device. The antenna interface allows for the coupling of an antenna during normal use, and also allows for the direct coupling of test equipment for accurate production line testing of the internal RF circuit. The use of a single interface for both the antenna and manufacturing test equipment increases the convenience and reliability of production line testing. No radiated fields are produced, therefore interference from adjacent, simultaneously performed testing is minimized. Furthermore, direct electrical coupling to the antenna interface of the wireless communication device both reduces and improves the repeatability of the coupling impedance, thereby increasing the accuracy and reliability of the test measurements. In a particularly suitable embodiment, the antenna interface is provided on a cellular telephone.

Accordingly, in one aspect of the present invention, an interface for conductively connecting RF signal generation circuitry inside a wireless communication device to both an antenna and alternatively to test equipment is provided. The antenna interface of this embodiment comprises an outer shell of conductive material, an inner shell of conductive material, and an intermediate shell of dielectric material. Preferably, the interior surface of the inner conductive shell is threaded or otherwise configured for attachment to other equipment. This allows convenient and efficient coupling to both an antenna and test equipment. Most preferably, the inner conductive shell is coupled to the RF signal output of the device, and the outer conductive shell is coupled to a ground reference.

In another aspect of the present invention, a method of testing a wireless communication device is provided. In this method, the wireless communication device incorporates an antenna interface, and a connector is attached to the antenna interface such that a first portion of the connector is electrically coupled to a grounded portion of the antenna interface, and a second portion of the connector is coupled to a signal output portion of the antenna interface. Test equipment is electrically coupled to the connector, and the functionality of the wireless communication device is tested. The connector is decoupled from the antenna interface, and an antenna is attached thereto. The manufacture of the wireless communication device therefore takes place without using radiated fields to test functionality.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
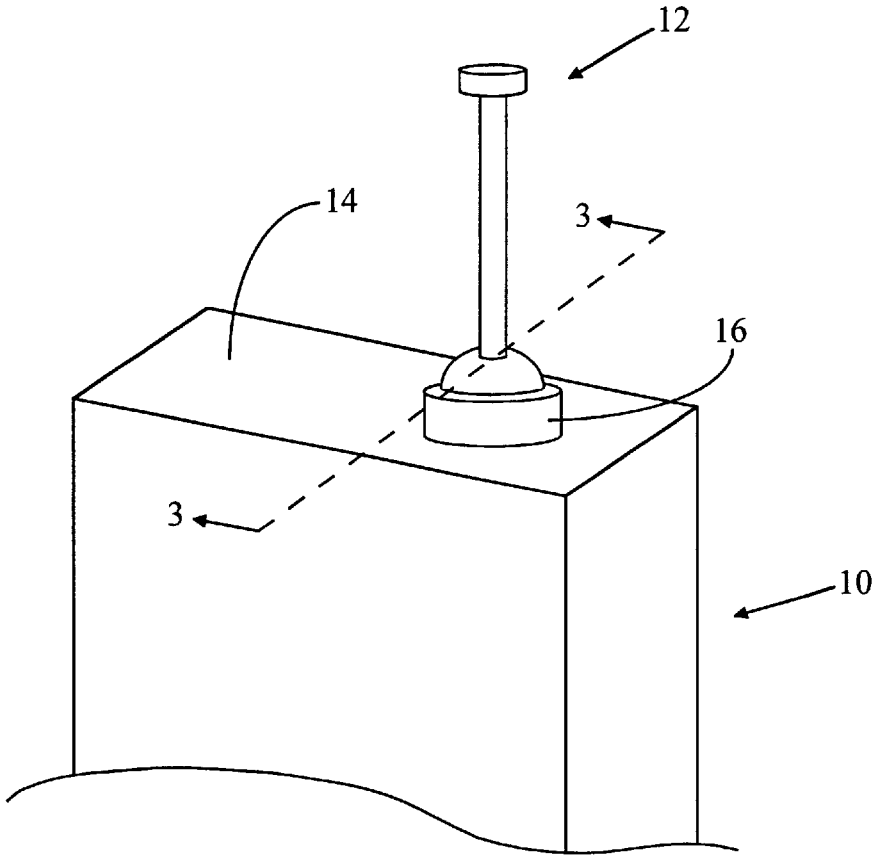
FIG. 1 is a perspective view of a wireless communication device and its associated antenna and antenna interface.

Referring now to FIG. 1, a wireless communication device 10 is illustrated. This device 10, may, for example, be a cellular telephone, although other wireless communication products such as wireless PC network equipment, pagers, and the like are also suitable for use in conjunction with the present invention. The device 10 includes an antenna 12, which is attached to the device housing 14 through an antenna interface 16. The antenna 12 may comprise a retractable antenna which slides into the device housing 14 when the device 10 is not in use, although those of skill in the art will appreciate that many antenna designs will be suitable for use with the present invention.

Figure 2:
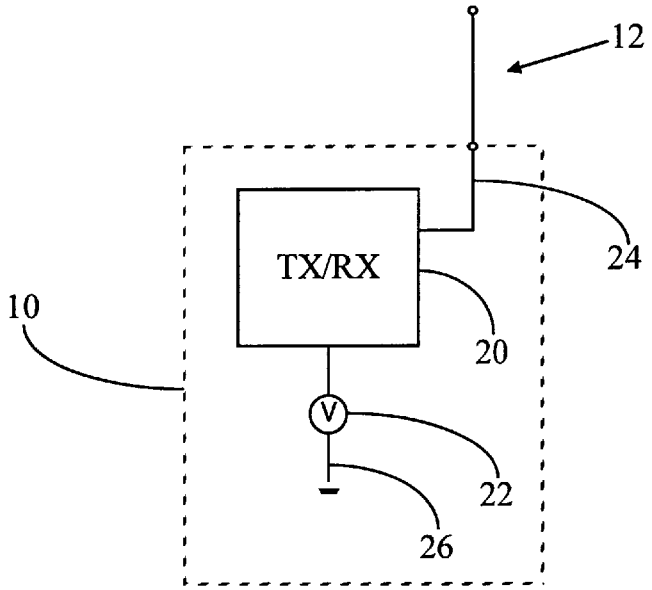
FIG. 2 is a schematic representation of a portion of the internal circuitry of the wireless communication device of FIG. 1.

A schematic representation of a portion of the functional circuitry inside the device 10 is presented in FIG. 2. As can be seen by reference to this Figure, the antenna 12 is coupled through the antenna interface 16 to a transmit/receive circuit 20 powered by a power source 22. The power source 22 is typically an internal battery, but may also comprise a connection to an external source of DC or AC current. The RF signal generation circuit inside the wireless communication device therefore additionally comprises a signal output conductor 24 which is electrically coupled to the antenna 12 on one end, and to the transmit/receive circuit 20 on its other end. Furthermore, a ground conductor 26, which comprises a signal common, is connected between the ground location and the power source 22. In some embodiments, the ground conductor 26 may be tied to a conductive coating provided on the internal surfaces of the housing 14 (FIG. 1).

When a wireless communication device such as a cellular telephone is manufactured, it is advantageous to perform functional tests on the transmit/receive circuitry 20 prior to shipment of the device to a customer. This helps ensure quality communication performance. Appropriate test equipment such as signal analyzers and RF power meters use a two wire input/output interface such as a coaxial cable. One method which may therefore be used to test the transmit/receive circuitry 20 is to couple the test equipment input/output line to a dipole testing antenna, which is placed near the antenna 12 of the wireless communication device 10 during test procedures. Signals are thus radiatively coupled between the device antenna 12 and the test equipment. This procedure, however, has disadvantages in that coupling efficiency is dependent on the relative placement and orientation of the two antennas, and interference can occur in the production line environment where many devices are being tested concurrently.

As an alternative, the two wire test equipment cable can be connected directly to the signal output conductor 24 and the ground conductor 26. A physical interface of this type would eliminate the use of radiative coupling and minimize the disadvantages noted above. Several options exist to accomplish this. For example, one of the test equipment I/O conductors could be directly attached to the signal output conductor 24 of the transmit/receive circuitry 20 at the antenna interface 16. However, such single conductor systems suffer from uncontrolled ground currents which produce large variations in coupling efficiency and undesired radiated energy from the test setup. Another alternative system may provide a separate test port on the housing of the device which is dedicated to the attachment of a test equipment input/output cable. This dedicated test port may be fed by a coaxial feed line to the RF generation circuitry. If desired, a switch may be provided in the signal output conductor 24 which alternatively routes the signal to the antenna interface 16 or the dedicated test port. However, such a system complicates the design of the RF circuit, and requires the provision of a separate connector on the external surface of the device 10. Furthermore, a switch in the signal output conductor 24 produces a 0.5 to 1 dB drop in signal level, which results in reduced operating time for a given battery capacity.

Figure 3:
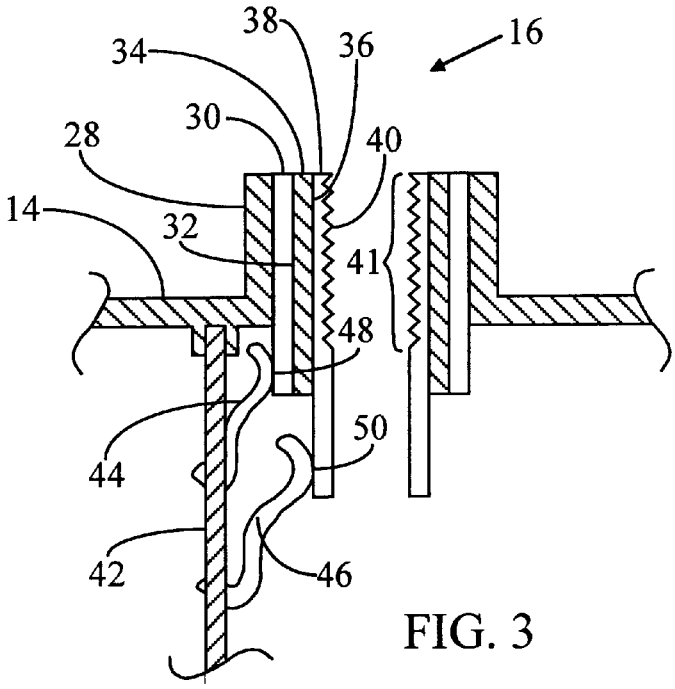
FIG. 3 is a cutaway view taken along lines 3—3 of the antenna interface of the wireless communication device of FIG. 1.

Addressing these drawbacks of alternative testing methods and apparatus, the present invention provides an antenna interface which also functions as a two conductor test port. A cross sectional view of a preferred antenna interface 16 is illustrated in FIG. 3. Referring now to this Figure, the top panel of the housing 14 is preferably made from a polymer material, and is most preferably molded with an upwardly extending flange 28 of circular axial cross section with respect to the longitudinal axis defined by the antenna 12 extension. Secured to the interior surface of this flange 28 is a cylindrical shell of conductive material 30, such as metal or copper alloy or other conductive material as is known in the art, which has a hollow cylindrically shaped interior defined by an interior surface 32. Secured to the interior surface 32 of this cylindrical conductive shell 30 is a cylindrical shell of dielectric material 34 having a cylindrically shaped interior surface identified as 36 in FIG. 3. This material may be any dielectric material with good microwave properties known in the art, with PTFE and polyethylene being two representative examples.

Secured to the interior surface 36 of the dielectric cylinder 34 is an inner cylindrical shell 38, comprising a conductive material as described above with respect to the outer cylindrical shell 30, and also comprising an interior surface 40. In one preferred embodiment, the interior surface 40 is provided with a threaded portion 41 located along the upper section of the interior surface 40. The threaded portion is configured to accept either an antenna coupler or a test equipment connector, as is explained in more detail below. The concentric securement of the flange 28 and the respective shells 30, 34, 38 may be accomplished in many ways well known to those of skill in the art, including a press fit, a threaded engagement, adhesive, sonic welding, or a combination of such methods.

The antenna interface 16 receives a signal from RF signal generation circuitry provided on an internal printed wiring board 42 secured within the housing 14 of the wireless communication device 10. On this printed wiring board 42 are two resilient contacts 44, 46. One contact 44 is connected to a ground plane on the printed wiring board 42, and is accordingly electrically tied to the ground conductor 26 of the RF signal generation circuitry. The other contact 46 is connected to a signal trace on the printed wiring board 42, and is accordingly electrically tied to the signal output conductor 24 of the RF signal generation circuitry. In this preferable embodiment, the printed wiring board 42 is mounted within the housing 14 such that the grounded contact 44 presses against an exterior surface 48 of the outer conductive shell 30, and the signal contact 46 presses against an exterior surface 50 of the inner conductive shell 38. As shown in FIG. 3, it is convenient to configure the antenna interface 16 such that the inner conductive cylinder 38 extends further into the housing 14 than either the outer conductive cylinder 30 or the intermediate dielectric cylinder 34. It is then possible to stagger the positions of the contacts 44, 46 on the printed wiring board 42 in such a way that each can contact the appropriate area of the antenna interface without any mechanical interference from the other. Of course, those of skill in the art will appreciate that many different ways of connecting the signal output conductor 24 and ground conductor 26 to this preferred concentric shell style antenna interface would be suitable, although contact configurations which minimize contact resistance and wear would be particularly preferred. As another example, spring loaded plungers as are described in co-pending U.S. patent application Ser. No. 08/579,985, entitled "IMPROVED ANTENNA FEED SYSTEM FOR PORTABLE RADIOTELEPHONES," filed on Dec. 28, 1995, assigned to the assignee of the present invention and incorporated herein by reference, may be utilized.

Figure 4:
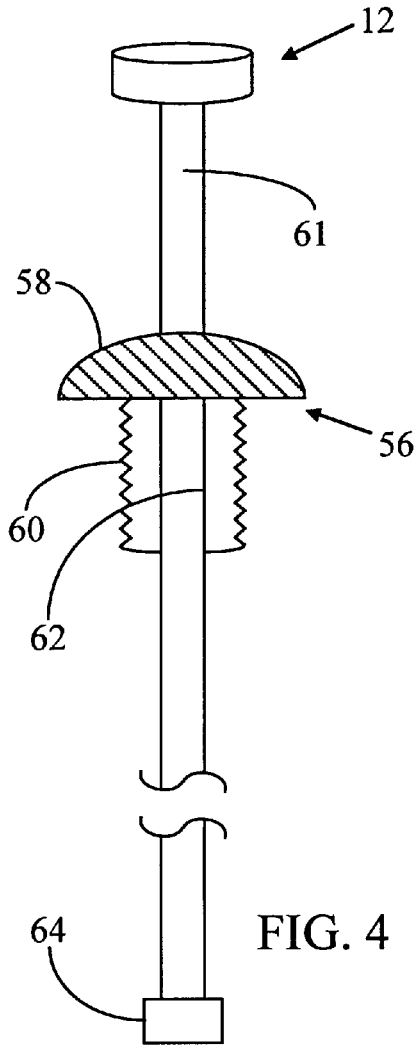
FIG. 4 is a cutaway view of an antenna with its associated antenna interface coupler.
Figure 5:
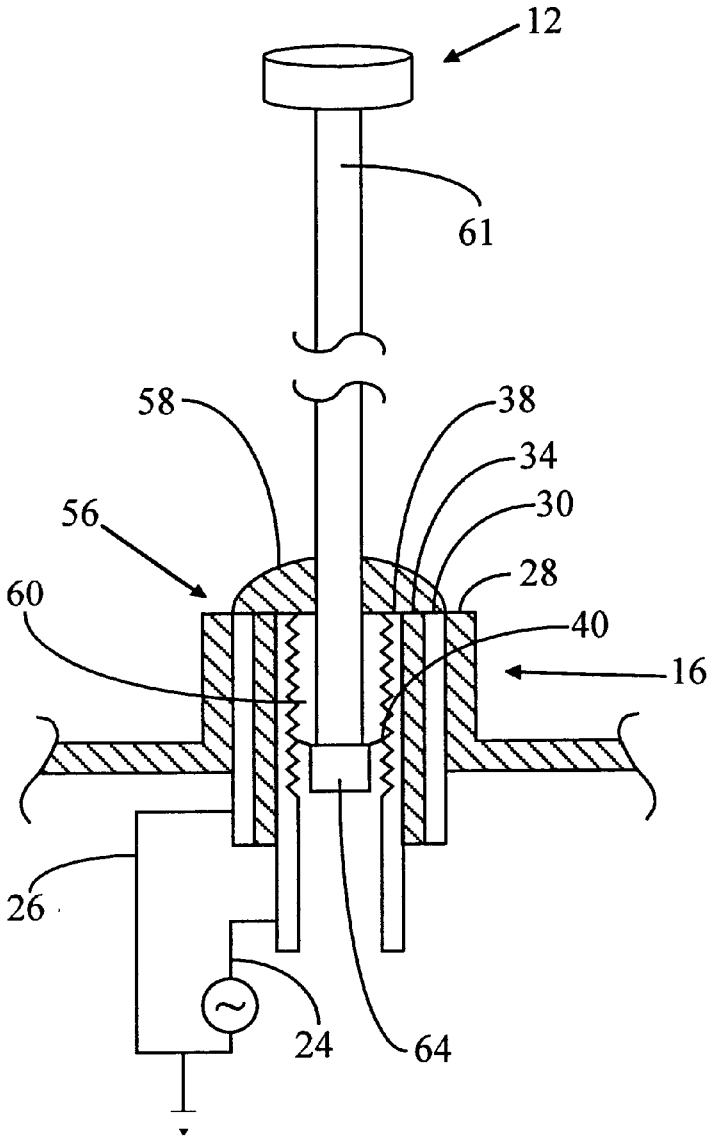
FIG. 5 is a cutaway view of the antenna and coupler of FIG. 4, installed in the antenna interface of FIG. 3.

Referring now to FIGS. 4 and 5, the coupling of an antenna to the antenna interface 16 is described. The antenna 12 comprises an elongated rod, which comprises a conductive radiating portion 61 extending at least partially along its length. This conductive portion 61 may or may not be encapsulated in a polymer material for flexibility, and may be helical or may comprise another configuration to minimize its physical length while retaining suitable radiating properties. Many antenna configurations and designs are well known to those of skill in the art and are suitable for use with the present invention, and are not further described herein. FIG. 4 illustrates the antenna 12, as installed inside a coupler, designated generally as 56. The coupler 56 comprises a non-conductive head portion 58, and an externally threaded conductive shaft portion 60, which extends downward from the head 58. The coupler 56 further comprises a channel 62, extending longitudinally through its interior, within which the antenna 12 is slidably mounted.

FIG. 5 illustrates the antenna 12 and coupler 56 as they appear when coupled to the antenna interface 16 for general use in connection with a wireless communication device such as a cellular telephone. The externally threaded shaft portion 60 of the coupler 56 is sized to mate with the threads on the interior surface 40 of the inner conductive shell 38 of the antenna interface 16. Since the antenna 12 is slidably held in the coupler 56, it can be retracted within the housing 14 when not in use. During RF transmission, however, the antenna 12 is extended, and the top surface of a cap 64 made of conductive material which is electrically connected to the bottom of the antenna's radiating portion 61 engages the bottom surface of the conductive shaft portion 60 of the coupler 56. Preferably, this connection incorporates a positive engagement so that the user can feel when the antenna is fully extended. The bottom portion of the antenna 12 is therefore conductively connected to the inner shell 38 of the antenna interface 16, and is driven by the signal output conductor 24 of the RF signal generation apparatus. It can be appreciated that the head portion 58 of the coupler 56 is non-conductive so that no connection is made between the edge of the outer (grounded) conductive shell 30 and the antenna 12. Alternatively, the coupler 56 could be made entirely of conductive material, and a washer (not shown) of dielectric material could be placed between the top surface of the antenna interface 16 and the bottom surface of the head 58 of the coupler 56.

As discussed above, the antenna interface 16 can also be utilized to provide a two wire test equipment interface for convenient and accurate testing during the manufacture of the wireless communication device 10. This is preferably accomplished with the use of a connector 68, illustrated in FIG. 6. The connector 68 is used to adapt the antenna interface 16 (illustrated in FIG. 3) to a test equipment input/output cable (shown as element 92 in FIG. 8 and discussed below). In the advantageous embodiment illustrated in FIG. 6, an upper portion 70 of the connector 68 is configured as an SMA plug, adapted to couple to the SMA format input/output cable receptacle commonly used in the test equipment industry. A second portion 72 of the connector 68 is adapted to couple to the antenna interface 16 of FIG. 3. Accordingly, a preferred test equipment connector comprises an externally threaded shaft portion 74 having an integral axially extending pin 76 directed upwardly from the top of the shaft portion 74. The pin 76 is surrounded by an externally threaded shell portion 78, which is connected to the upper end of the shaft 74 and to the integral pin 76 by an insulating bushing 80 which extends radially from the shaft 74 and pin 76 outward to the shell 78. The shell portion 78 preferably also comprises a circumferentially extending flange 82 having a protruding ridge 84 which extends downwardly from the bottom surface of the flange 82. This ridge 84 is used for making electrical contact with the outer cylindrical shell 30 of the antenna interface, as is illustrated in FIG. 7.

Figure 6:
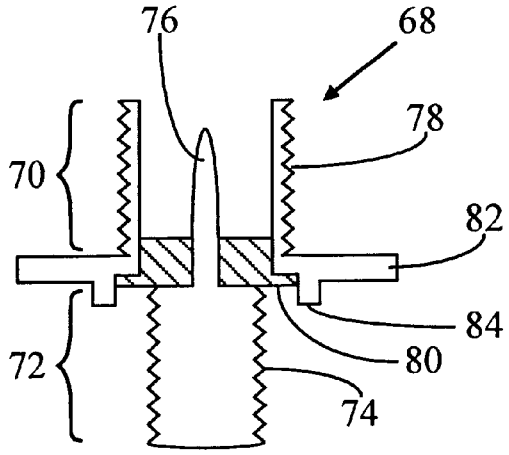
FIG. 6 is a cutaway view of an antenna interface adapter for coupling test equipment to the antenna interface of FIG. 3.
Figure 7:
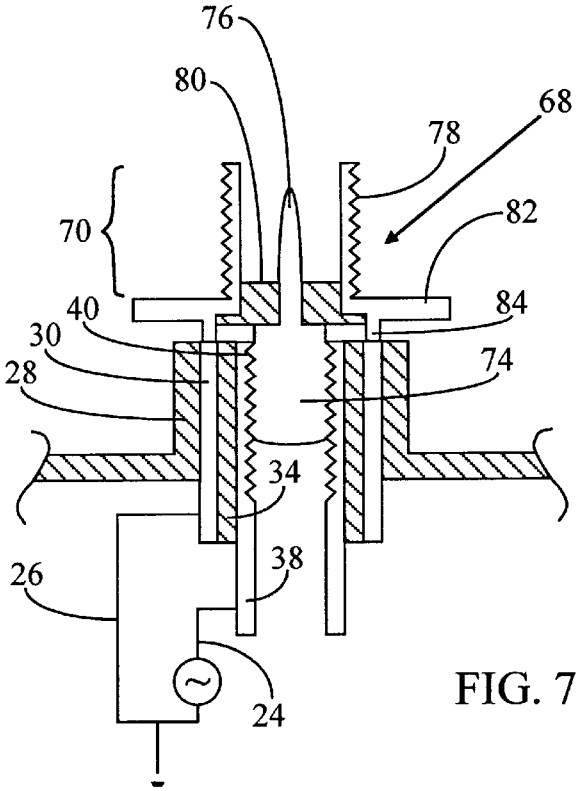
FIG. 7 is a cutaway view of the antenna interface adapter of FIG. 6, installed in the antenna interface of FIG. 3.
Figure 8:
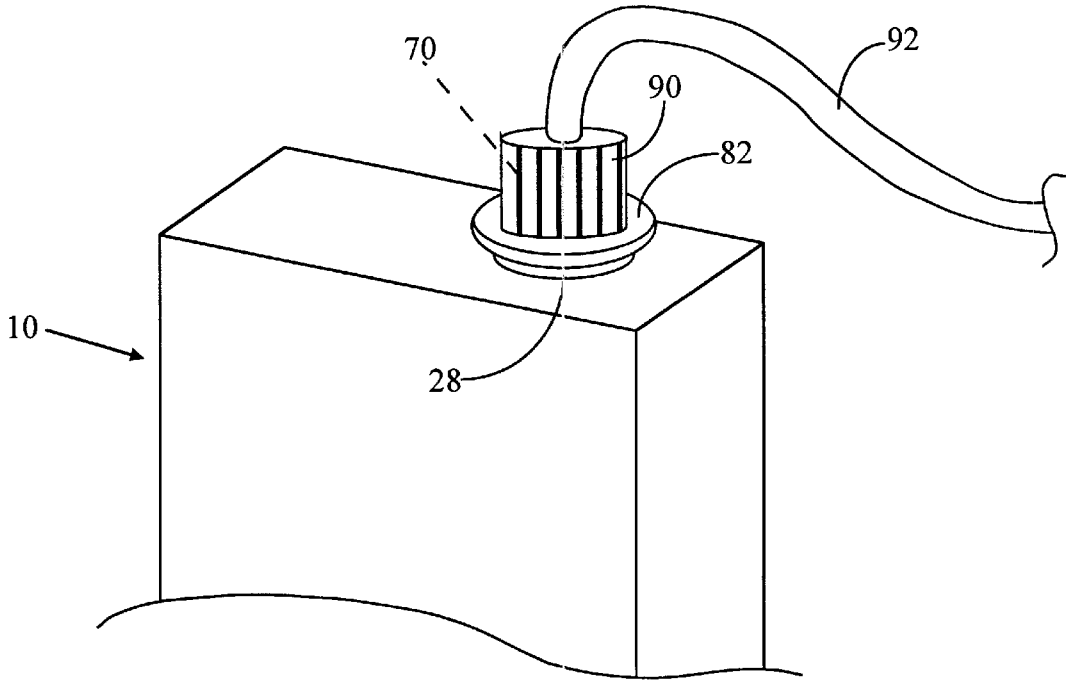
FIG. 8 is a perspective view of a coaxial test equipment cable coupled to the installed antenna interface adapter of FIG. 7.

Referring now to FIG. 7, the connector 68 of FIG. 6 is illustrated installed into the antenna interface 16. The threads on the shaft portion 74 of the connector 68 are sized to threadably engage the threads on the interior surface 40 of the inner conductive shell 38 of the antenna interface 16. The downwardly protruding ridge 84 is of a diameter and thickness approximately equal to the diameter and thickness of the outer conductive shell 30 of the antenna interface 16, such that when the connector 68 is installed in the antenna interface 16 the ridge 84 is in alignment with the conductive shell 38 along their common longitudinal axis. It can be appreciated therefore that as the shaft portion 74 is threaded into the antenna interface 16, the downwardly protruding ridge 84 will become seated onto the top edge of the outer conductive shell 30. This provides a low impedance connection between the externally threaded shell portion 78 of the connector 68 and the outer conductive shell 30 of the antenna interface. The integral pin 76, of course, is conductively connected to the inner conductive shell 38 of the antenna interface. The resulting effect is to produce an SMA format plug on the exterior of the wireless communication device 10, wherein the shell portion 78 of the connector 68 is electrically tied to the ground conductor of the internal RF generation circuitry, and the inner pin 76 of the connector 68 is electrically tied to the signal output conductor of the internal RF generation circuitry. As can best be seen by reference to FIG. 8, the SMA format portion 70 of the connector can then be easily attached to an SMA format receptacle 90 on the end of a test equipment input/output cable 92. It will be appreciated by those skilled in the art that the design of the above described connector may be altered in its configuration without departing from the spirit of the invention disclosed herein. It is of course preferable that the test equipment connector 68 be coupled to both a signal and ground contact with a low impedance, but the specific implementation of such low impedance contacts can take many different forms.

The invention described above permits the performance of an accurate and convenient test protocol. In particular, prior to attaching the antenna 12 to the device 10, the connector 68 is threaded into the antenna interface 16. Suitable test equipment is coupled to the connector 68, and the device 10 is tested for acceptable functional performance. The connector is then removed from the device 10, and the antenna 12 is threaded into the antenna interface 16.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. A wireless communication device comprising:

signal generation circuitry, including a signal output conductor and a ground conductor;

an antenna interface comprising a first conductive surface coupled to said ground conductor, and a second conductive surface coupled to said signal output conductor, said first and second conductive surfaces being substantially cylindrical said antenna interface for receiving a test equipment interface connector comprising a first portion connected to said first conductive surface, and a second portion in threaded mating contact with said second conductive surface, and for receiving an antenna comprising a conductive portion for contacting said second conductive surface; and wherein said first portion of said test equipment interface connector comprises a ridge which contacts an end of said first conductive surface when said second portion of said test equipment interface connector is threadably mated to said second conductive surface.

2. A wireless communication device comprising:

signal generation circuitry, including a signal output conductor and a ground conductor;

an antenna interface comprising a first conductive surface coupled to said ground conductor, and a second conductive surface coupled to said signal output conductor, said antenna interface for receiving a test equipment interface connector, and for receiving an antenna comprising a conductive portion for contacting said second conductive surface, said test equipment interface connector comprising a first portion connected to said first conductive surface, and a second portion in contact with said second conductive surface, said first portion of said test equipment interface connector comprising a ridge which contacts an end of said first conductive surface when said second portion of said test equipment interface connector is threadably mated to said second conductive surface, a portion of said test equipment interface connector defining an SMA format plug for accepting an SMA format receptacle coupled to a piece of test equipment.

* * * * *